US009841717B2

(12) United States Patent
Kikuchi et al.

(10) Patent No.: US 9,841,717 B2
(45) Date of Patent: Dec. 12, 2017

(54) CLEANING DEVICE AND IMAGE FORMING APPARATUS

(71) Applicant: FUJI XEROX CO., LTD., Tokyo (JP)

(72) Inventors: Yuji Kikuchi, Kanagawa (JP); Yu Tsuda, Kanagawa (JP); Yasunori Unagida, Kanagawa (JP); Kanji Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/226,033

(22) Filed: Aug. 2, 2016

(65) Prior Publication Data

US 2017/0261912 A1 Sep. 14, 2017

(30) Foreign Application Priority Data

Mar. 11, 2016 (JP) ..... 2016-048873

(51) Int. Cl.
*G03G 21/00* (2006.01)

(52) U.S. Cl.
CPC ..... *G03G 21/0094* (2013.01); *G03G 21/0035* (2013.01)

(58) Field of Classification Search
CPC ..... G03G 21/00; G03G 21/0005; G03G 21/0094; G03G 21/0035
See application file for complete search history.

(56) References Cited

U.S. PATENT DOCUMENTS

2001/0022910 A1* 9/2001 Sawayama ..... G03G 21/0035 399/353
2005/0220513 A1* 10/2005 Curynski ..... G03G 21/0005 399/346
2011/0064495 A1* 3/2011 Tanaka ..... G03G 21/0035 399/349
2011/0142485 A1* 6/2011 Ishikawa ..... G03G 21/0035 399/101
2011/0206430 A1* 8/2011 Arai ..... B08B 1/00 399/346

FOREIGN PATENT DOCUMENTS

JP 11-219089 A 8/1999
JP 2011018004 A * 1/2011
JP 2013-225050 A 10/2013

* cited by examiner

*Primary Examiner* — Francis Gray
(74) *Attorney, Agent, or Firm* — Sughrue Mion, PLLC

(57) ABSTRACT

A cleaning device includes a rotating brush that supplies lubricant to a surface of an image carrying member on which an end toner image is formed at a first axial end, a cleaning member provided on a downstream side of the rotating brush in a direction of rotation of the image carrying member and that cleans the image carrying member by scraping toner from the surface of the image carrying member, a storing portion that stores the toner scraped by the cleaning member, a transporting member that transports the toner in the storing portion from the first axial end of the image carrying member toward a second axial end of the image carrying member, and a moving member that moves the toner in the storing portion toward the rotating brush.

22 Claims, 12 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2016-048873 filed Mar. 11, 2016.

BACKGROUND

Technical Field

The present invention relates to a cleaning device and an image forming apparatus.

SUMMARY

According to an aspect of the invention, there is provided a cleaning device including a rotating brush that supplies lubricant to a surface of an image carrying member on which an end toner image is formed at a first axial end, a cleaning member provided on a downstream side of the rotating brush in a direction of rotation of the image carrying member and that cleans the image carrying member by scraping toner from the surface of the image carrying member, a storing portion that stores the toner scraped by the cleaning member, a transporting member that transports the toner in the storing portion from the first axial end of the image carrying member toward a second axial end of the image carrying member, and a moving member that moves the toner in the storing portion toward the rotating brush.

BRIEF DESCRIPTION OF THE DRAWINGS

Exemplary embodiments of the present invention will be described in detail based on the following figures, wherein.

DETAILED DESCRIPTION

A cleaning device and an image forming apparatus according to a first exemplary embodiment of the present invention will now be described with reference to relevant drawings, wherein an arrow V represents the vertical direction, and an arrow W represents the horizontal direction corresponding to the widthwise direction of the apparatus (hereinafter referred to as "the apparatus-width direction").

First Exemplary Embodiment

Figure 1:
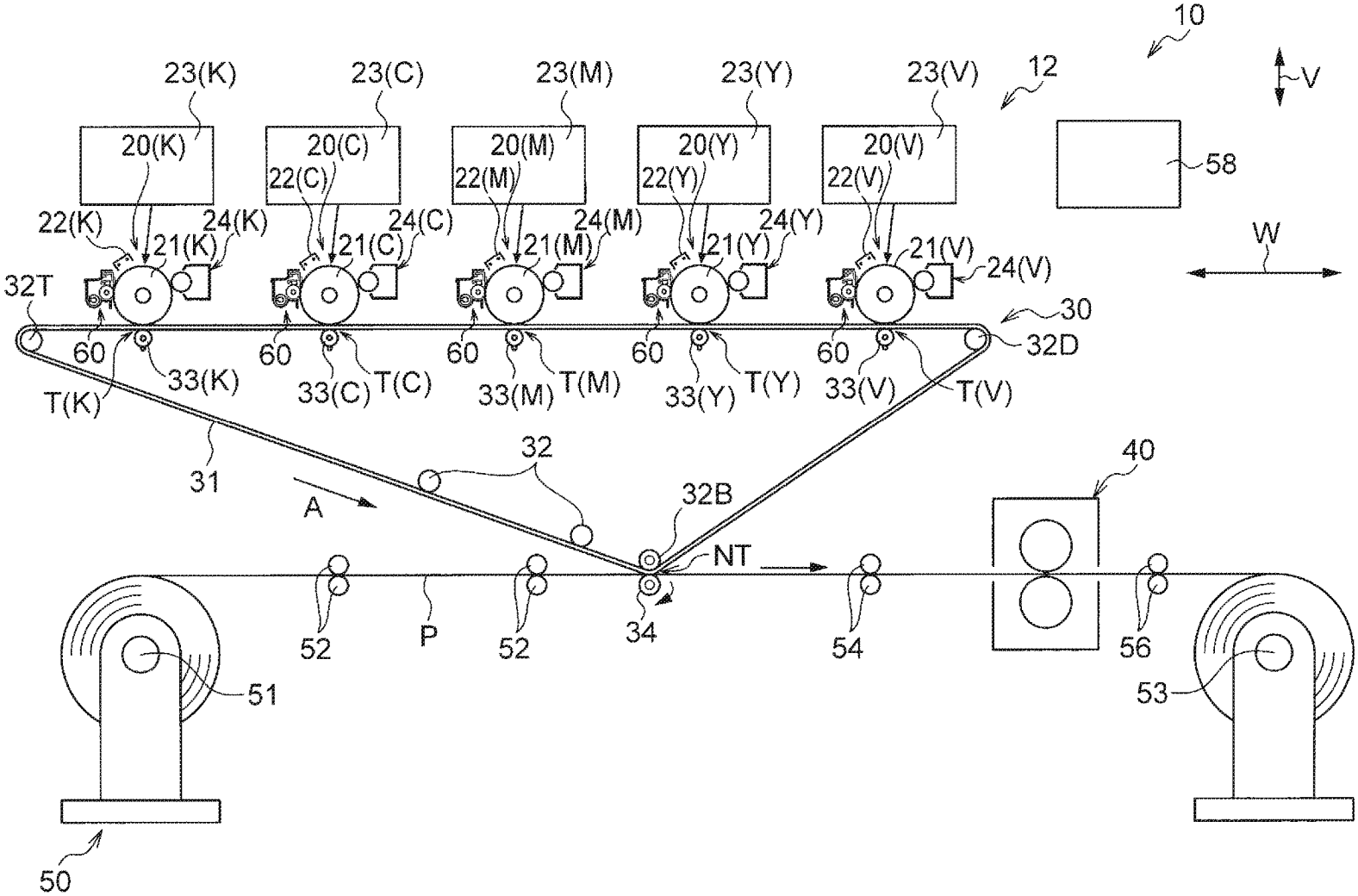
FIG. 1 is a schematic diagram illustrating a configuration of an image forming apparatus, seen from the front side, according to a first exemplary embodiment.

FIG. 1 is a schematic diagram illustrating a configuration of an image forming apparatus 10, seen from the front side, according to the first exemplary embodiment. As illustrated in FIG. 1, the image forming apparatus 10 includes an image forming section 12 that electrophotographically forms an image on continuous-form paper P such as a label sheet, a transporting device 50 that transports the continuous-form paper P, and a controller 58 that controls operations of relevant elements included in the image forming apparatus 10.

As illustrated in FIG. 1, the transporting device 50 includes a feed roller 51 from which a roll of continuous-form paper P is unwound, a winding roller 53 on which the unwound continuous-form paper P is wound, and pairs of transport rollers 52, 54, and 56 that transport the continuous-form paper P. The winding roller 53 is rotated by a driving unit (not illustrated). Thus, the winding roller 53 winds up the continuous-form paper P while the feed roller 51 unwinds the continuous-form paper P.

The pairs of transport rollers 52 transport the continuous-form paper P from the feed roller 51 to a second-transfer position NT. The pair of transport rollers 54 transport the continuous-form paper P from the second-transfer position NT to a fixing device 40. The pair of transport rollers 56 transport the continuous-form paper P from the fixing device 40 to the winding roller 53.

The image forming section 12 includes toner-image-forming units 20 that form respective toner images, a transfer device 30 that transfers the toner images formed by the toner-image-forming units 20 to the continuous-form paper P, and the fixing device 40 that fixes the toner images on the continuous-form paper P by applying heat and pressure thereto.

The toner-image-forming units 20 form toner images in different colors. In the first exemplary embodiment, five toner-image-forming units 20 are provided for five colors of yellow (Y), magenta (M), cyan (C), black (K), and a special color (V). The toner-image-forming units 20 are arranged side by side in order of that for the special color (V), that for yellow (Y), that for magenta (M), that for cyan (C), and that for black (K) from the upstream side toward the downstream side in the direction of rotation of a transfer belt 31, which will be described later.

Suffixes (V), (Y), (M), (C), and (K) given to some reference numerals in FIG. 1 indicate the respective colors for which elements denoted by those reference numerals are provided. The special color (V) is, for example, silver or gold.

Figure 2:
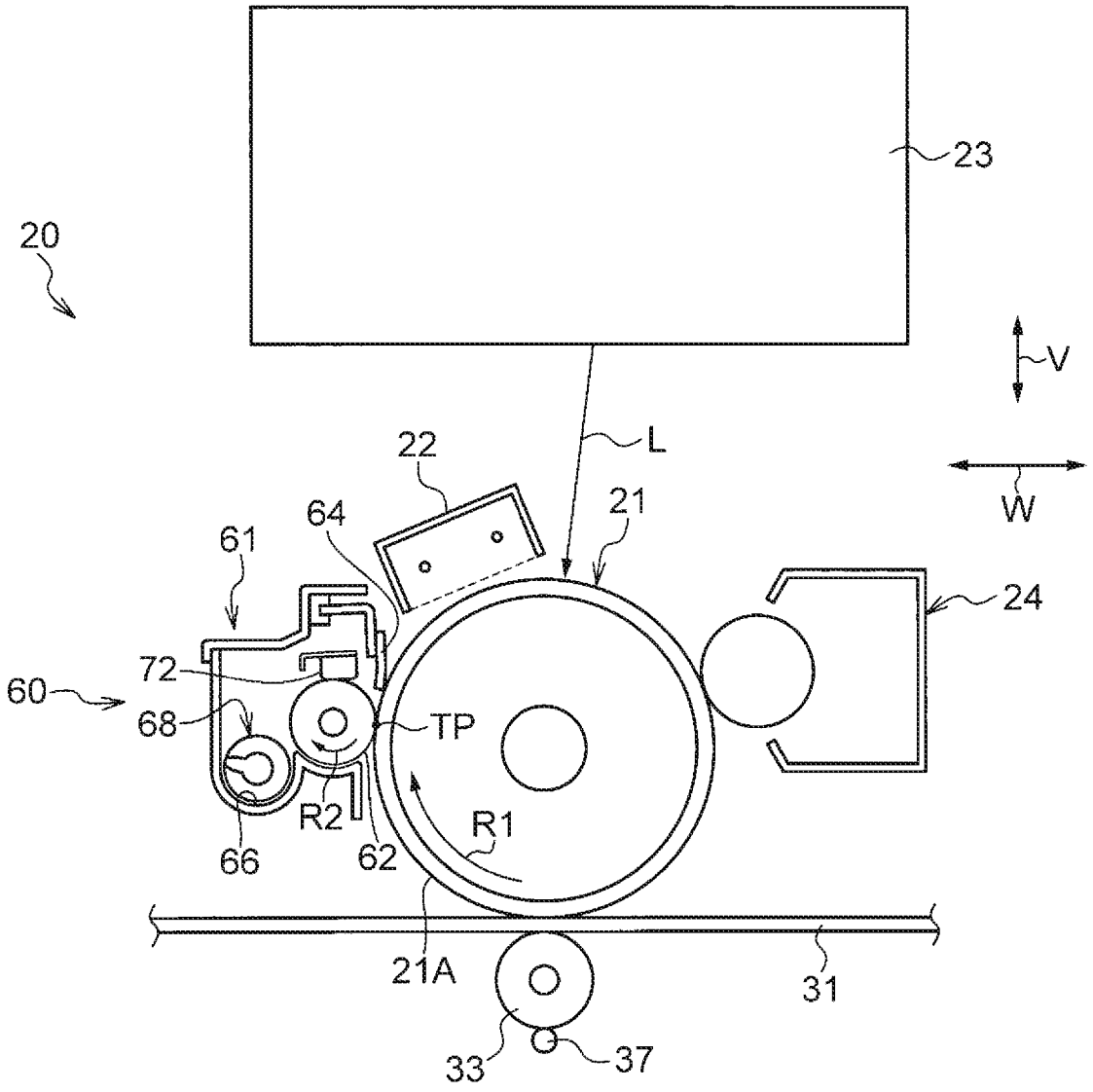
FIG. 2 is a schematic diagram of a toner-image-forming unit according to the first exemplary embodiment.

The toner-image-forming units 20 basically have the same configuration, except the kinds of toner to be used. Specifically, referring to FIG. 2, the toner-image-forming units 20 each include a photoconductor drum 21 (an exemplary photosensitive member) that rotates clockwise in FIG. 2, a charger 22 that charges the photoconductor drum 21, an exposure device 23 that exposes the photoconductor drum 21 charged by the charger 22 to light and thus forms an electrostatic latent image on the photoconductor drum 21, a developing device 24 that develops the electrostatic latent image formed on the photoconductor drum 21 by the exposure device 23 and thus forms a toner image, and a cleaning device 60 that removes residual toner particles from the surface of the photoconductor drum 21 having undergone the transfer of the toner image to the transfer device 30.

The charger 22 charges the surface (a photosensitive layer) of the photoconductor drum 21 to have, for example, negative polarity. The negatively charged surface of the photoconductor drum 21 is exposed to exposure light L emitted from the exposure device 23. The exposed part of the photoconductor drum 21 comes to have positive polarity, whereby an electrostatic latent image is formed on the surface of the photoconductor drum 21. Toner in the developing device 24 is triboelectrically charged to have negative polarity. The negatively charged toner is attracted to the positively charged electrostatic latent image, whereby the electrostatic latent image is developed. In this manner, a toner image is formed on a surface (outer peripheral surface) 21A of the photoconductor drum 21. Thus, in the first exemplary embodiment, a combination of the charger 22, the exposure device 23, and the developing device 24 serves as an exemplary forming unit that forms a toner image on the photoconductor drum 21.

The cleaning device 60 includes a blade 64 as an exemplary cleaning member, which will be described later. The blade 64 is provided in contact with the surface 21A of the photoconductor drum 21 and thus scrapes residual toner particles from the surface 21A of the photoconductor drum 21. Such toner particles are temporarily stored in a storing portion 66 and are then discharged from a discharge port (not illustrated). The toner particles discharged from the storing portion 66 are transported to a toner collecting box (not illustrated).

The transfer device 30 transfers, in first transfer, the toner images formed on the respective photoconductor drums 21 to the transfer belt 31 (an intermediate transfer body) such that the toner images are superposed one on top of another, and further transfers, in second transfer, the set of toner images superposed on the transfer belt 31 to the continuous-form paper P at the second-transfer position NT (an exemplary transfer nip). Specifically, as illustrated in FIG. 1, the transfer device 30 includes the transfer belt 31, first-transfer rollers 33, and a second-transfer roller 34.

Referring to FIG. 1, the transfer belt 31 has an endless shape and is positioned by being stretched around plural rollers 32. In the first exemplary embodiment, the transfer belt 31 has an inverted obtuse-triangular shape in front view with the base thereof extending in the apparatus-width direction. Among the plural rollers 32 illustrated in FIG. 1, the roller 32D serves as a driving roller that is driven by a motor (not illustrated) and thus rotates the transfer belt 31 in a direction indicated by an arrow A. The transfer belt 31 transports the toner images transferred thereto in the first transfer to the second-transfer position NT by rotating in the direction of the arrow A.

Among the plural rollers 32 illustrated in FIG. 1, the roller 32T serves as a tension-applying roller that applies tension to the transfer belt 31. Among the plural rollers 32 illustrated in FIG. 1, the roller 32B serves as a counter roller for the second-transfer roller 34. The counter roller 32B is provided at the obtuse vertex, i.e., the lower end, of the transfer belt 31 having the inverted obtuse-triangular shape. The transfer belt 31 is in contact with the photoconductor drums 21 for the respective colors from below at the base, i.e., the upper side, extending in the apparatus-width direction.

The first-transfer rollers 33 transfer the toner images on the respective photoconductor drums 21 to the transfer belt 31. As illustrated in FIG. 1, the first-transfer rollers 33 are provided on the inner side of the transfer belt 31 and across the transfer belt 31 from the respective photoconductor drums 21. A first-transfer voltage of the polarity opposite to the polarity of the toner is applied to each of the first-transfer rollers 33 from a power-feeding unit 37 (see FIG. 2). With the application of the first-transfer voltage, the toner images on the respective photoconductor drums 21 are transferred to the transfer belt 31 at respective first-transfer positions T each defined between a corresponding one of the photoconductor drums 21 and a corresponding one of the first-transfer rollers 33.

The second-transfer roller 34 transfers the toner images superposed on the transfer belt 31 to the continuous-form paper P. As illustrated in FIG. 1, the second-transfer roller 34 is provided such that the transfer belt 31 is held between the second-transfer roller 34 and the counter roller 32B. The second-transfer roller 34 and the transfer belt 31 are in contact with each other under a predetermined load. The nip between the second-transfer roller 34 and the transfer belt 31 that are in contact with each other is defined as the second-transfer position NT. The second-transfer position NT is supplied with the continuous-form paper P transported from the feed roller 51. The second-transfer roller 34 rotates clockwise in FIG. 1.

Furthermore, a negative voltage is applied to the counter roller 32B from an application unit (not illustrated). Therefore, a potential difference is produced between the counter roller 32B and the second-transfer roller 34. Since the negative voltage is applied to the counter roller 32B, a second-transfer voltage (a positive voltage) of the polarity opposite to the polarity of the toner is indirectly applied to the second-transfer roller 34, which serves as a counter electrode for the counter roller 32B. Thus, a transfer electric field is generated between the counter roller 32B and the second-transfer roller 34, and an electrostatic force acts on the toner images on the transfer belt 31. Consequently, the toner images on the transfer belt 31 are transferred to the continuous-form paper P passing through the second-transfer position NT.

Featured Elements

Elements featured in the first exemplary embodiment will now be described.

Figure 5:
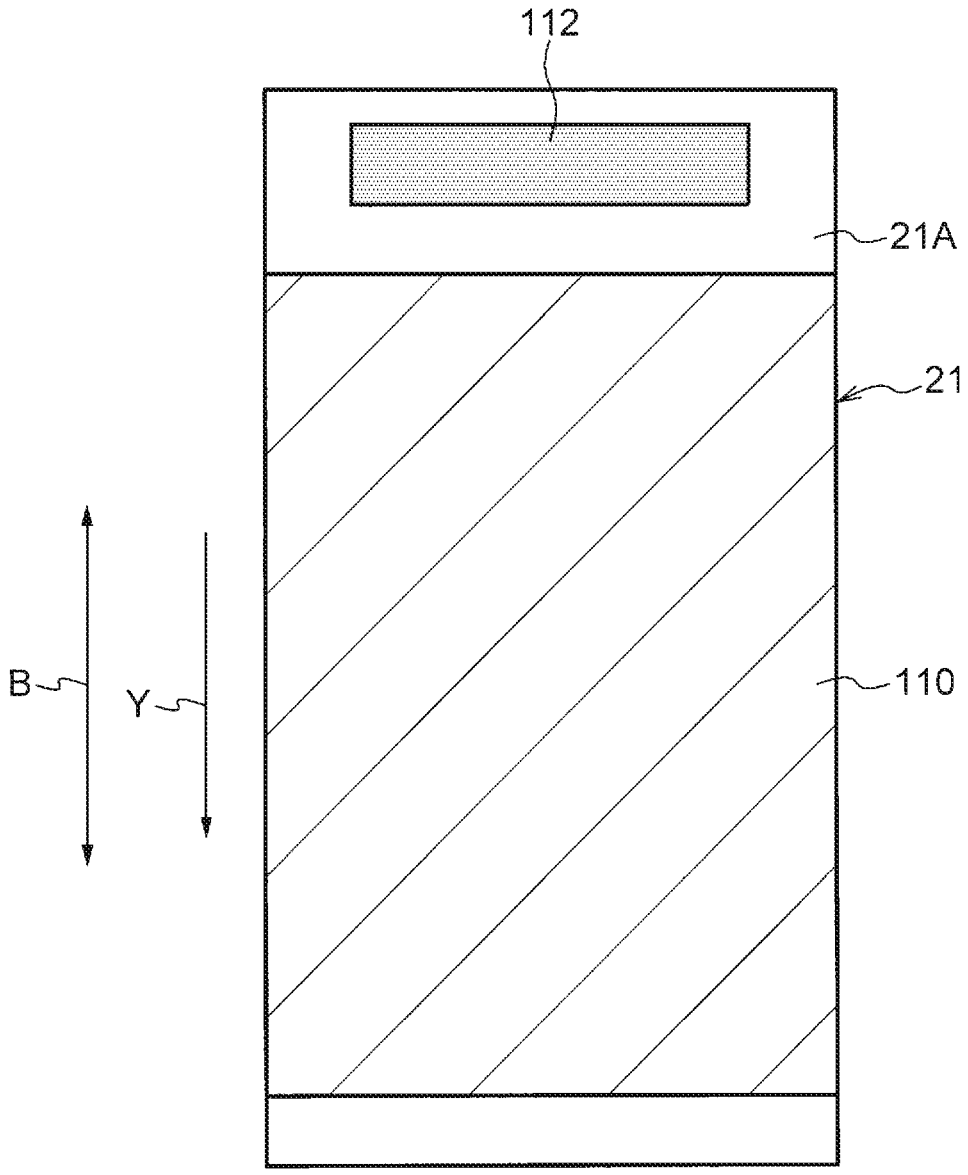
FIG. 5 is a development of a photoconductor drum according to the first exemplary embodiment.

FIG. 5 is a development of a representative one of the photoconductor drums 21 and illustrates the surface 21A thereof. In FIG. 5, the axial direction of the photoconductor drum 21 is represented by an arrow B. As illustrated in FIG. 5, the toner image that is formed on the photoconductor drum 21 includes a transfer-object image 110 (an exemplary toner image according to the present invention) formed in each of transfer areas P1 (see FIG. 6) defined on the continuous-form paper P, and a toner band 112 for protection of the blade 64 (an exemplary end toner image according to the present invention). Specifically, the transfer-object image 110 is formed in an area containing an axially central area of the surface 21A of the photoconductor drum 21, and the toner band 112 is formed at a first axial end of the surface 21A of the photoconductor drum 21.

Figure 6:
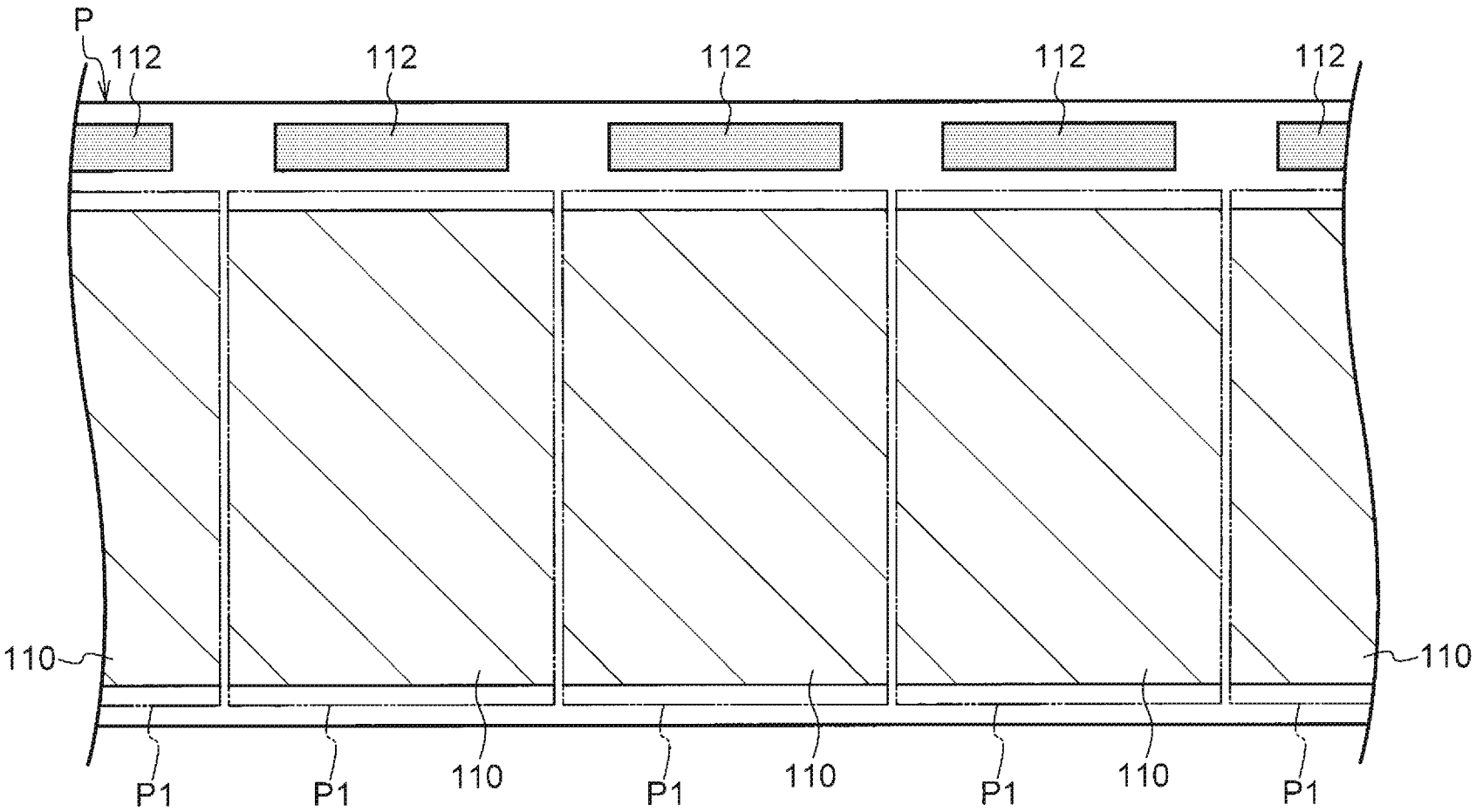
FIG. 6 is a schematic diagram illustrating transfer-object images and toner bands that are formed on continuous-form paper in the first exemplary embodiment.

According to the first exemplary embodiment, the transfer-object image 110 transferred from the photoconductor drum 21 to the transfer belt 31 is transferred to each of the transfer areas P1 that are defined on the continuous-form paper P as illustrated in FIG. 6, whereas the toner band 112 transferred from the photoconductor drum 21 to the transfer belt 31 is transferred to each of areas that are at a first widthwise end of the continuous-form paper P (an end in a direction orthogonal to the longitudinal direction of the continuous-form paper P).

The toner band 112 (an exemplary end toner image) formed on the photoconductor drum 21 (an exemplary photosensitive member) is composed of toner particles that are regularly ejected from the developing device 24. The toner particles that are to form the toner band 112 is supplied to the tip of the blade 64 so as to protect the blade 64. The toner band 112 is a strip-shaped end toner image that is formed at a relatively high image density (image density is also regarded as the amount of toner per unit area). The end toner image according to the present invention is not limited to a strip-shaped image.

Figure 3:
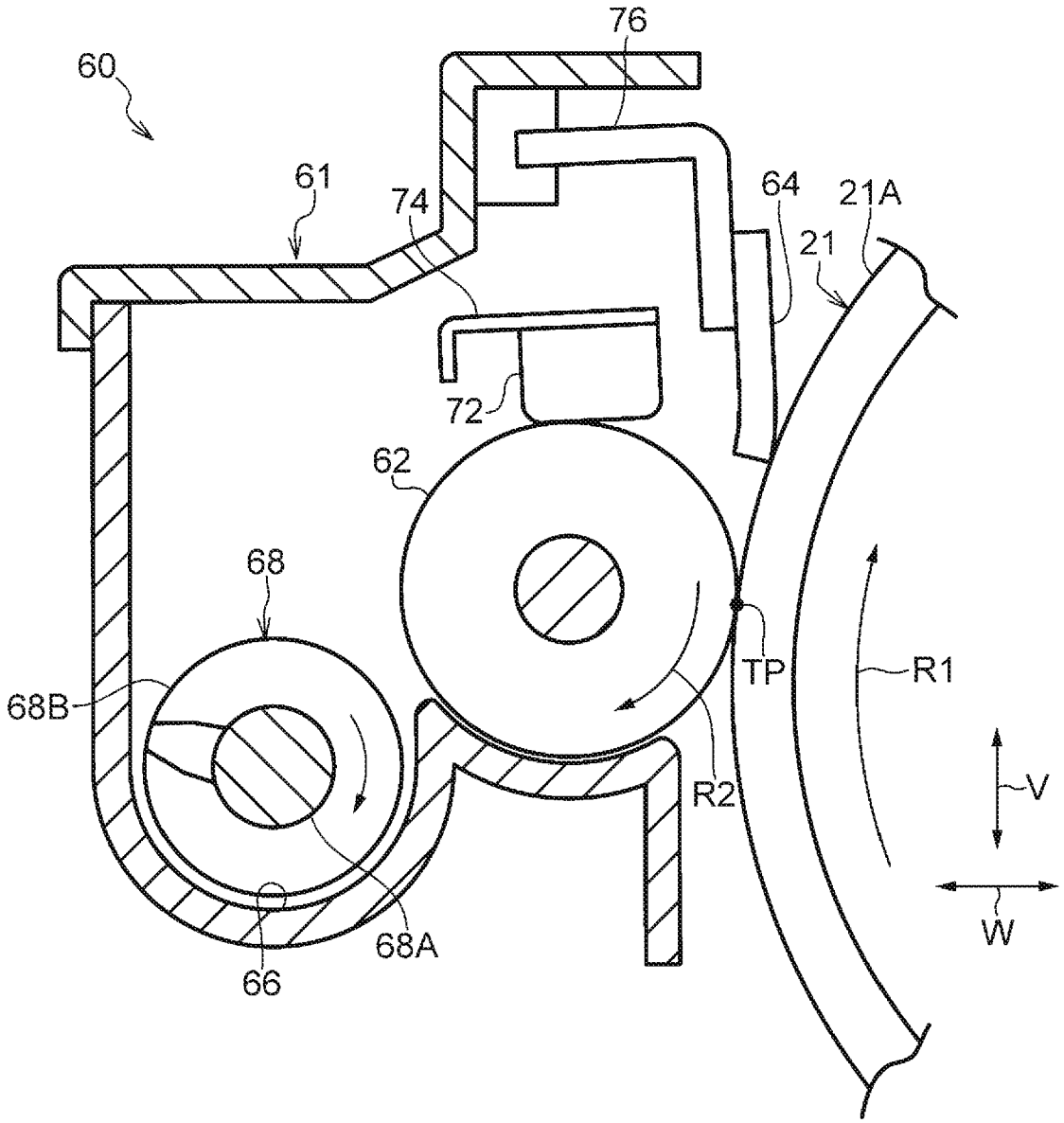
FIG. 3 is a side sectional view of a cleaning device according to the first exemplary embodiment.

Referring now to FIG. 3, the cleaning device 60 that cleans the photoconductor drum 21 includes a housing 61 as an exemplary device body. The longitudinal direction of the housing 61 corresponds to the axial direction of the photoconductor drum 21. The housing 61 is open on a side thereof facing the photoconductor drum 21.

The cleaning device 60 further includes a rotating brush 62 that supplies lubricant to the surface 21A of the photoconductor drum 21, the blade 64 provided on the downstream side of the rotating brush 62 in the direction of rotation of the photoconductor drum 21 and that scrapes toner particles off the surface 21A of the photoconductor drum 21, the storing portion 66 that stores the toner particles scraped by the blade 64, an auger 68 (an exemplary transporting member) that transports the toner particles in the storing portion 66 from the first axial end of the photoconductor drum 21 to a second axial end of the photoconductor drum 21, and plural puddle members 70 (exemplary moving members) that move the toner particles in the storing portion 66 toward the rotating brush 62.

The rotating brush 62 is provided in the housing 61 and is rotatably supported by bearings (not illustrated) provided at two respective longitudinal ends of the housing 61. The rotating brush 62 rotates in a direction (represented by an arrow R2 in FIG. 3) the same as the direction of rotation of the photoconductor drum 21 (represented by an arrow R1 in FIG. 3) by receiving a driving force transmitted thereto from a drive source (not illustrated). Therefore, the bristles of the rotating brush 62 and the surface 21A of the photoconductor drum 21 move in opposite directions at a contact point TP between the rotating brush 62 and the surface 21A of the photoconductor drum 21. The rotating brush 62 first comes into contact with a stick-like lubricant supplying member 72 provided at a position on the periphery of the rotating brush 62, and then comes into contact with the surface 21A of the photoconductor drum 21, whereby the lubricant is supplied to the surface 21A of the photoconductor drum 21. The lubricant supplying member 72 is provided on the upstream side of the contact point TP in the direction of rotation of the rotating brush 62. The longitudinal direction of the lubricant supplying member 72 corresponds to the longitudinal direction of the housing 61. The lubricant supplying member 72 is attached to the housing 61 with the aid of a bracket 74.

The blade 64 is attached to an upper part of the housing 61 with the aid of a bracket 76. The blade 64 is in contact with the photoconductor drum 21 at the tip thereof and cleans the surface 21A of the photoconductor drum 21 by scraping post-transfer residual toner particles (toner particles remaining on the surface 21A after the transfer process) off the surface 21A.

The storing portion 66 is provided at a lower part of the housing 61. Specifically, the storing portion 66 is provided at a position farther from the photoconductor drum 21 than the rotating brush 62. That is, the rotating brush 62 is provided between the photoconductor drum 21 and the storing portion 66. The storing portion 66 is a trough-like portion extending from a first longitudinal end of the housing 61 to a second longitudinal end of the housing 61. The depth of the storing portion 66 is substantially constant in the direction in which the storing portion 66 extends.

Figure 4:
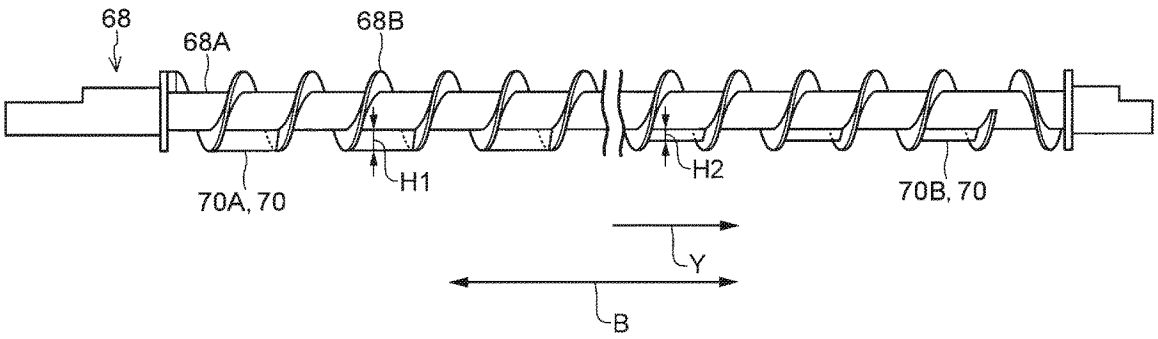
FIG. 4 is a front view of an auger included in the cleaning device according to the first exemplary embodiment.

The auger 68 is provided in the storing portion 66 and extends in the longitudinal direction of the housing 61. The auger 68 is rotatably supported by bearings (not illustrated) provided at the two respective longitudinal ends of the housing 61. Specifically, a shaft portion 68A of the auger 68 is rotatably supported at two ends thereof by the bearings provided at the two longitudinal ends of the housing 61. The auger 68 is rotated in the same direction as the photoconductor drum 21 by receiving a driving force transmitted thereto from a drive source (not illustrated). Referring to FIG. 4, the auger 68 includes a helical or substantially helical transporting blade 68B provided around the shaft portion 68A. The transporting blade 68B is an exemplary projecting portion projecting from the surface (outer peripheral surface) of the shaft portion 68A and converts the rotational force transmitted to the shaft portion 68A into a transporting force that transports the toner particles in the storing portion 66 from the first axial end of the photoconductor drum 21 to the second axial end of the photoconductor drum 21. Hereinafter, the direction in which the toner particles are transported by the auger 68 (a direction from the first axial end of the photoconductor drum 21 toward the second axial end of the photoconductor drum 21) is occasionally referred to as "the direction of toner transport" (a direction represented by an arrow Y in FIGS. 4 and 5). The toner particles transported by the auger 68 are discharged from a discharge port (not illustrated) provided at the second longitudinal end of the housing 61. The discharge port communicates with the storing portion 66.

As illustrated in FIG. 4, the plural puddle members 70 (exemplary plate members) each having a plate-like shape are arranged at intervals in the axial direction of the auger 68 (the shaft portion 68A). For example, the puddle members 70 are provided in alternate gaps between the turns of the transporting blade 68B of the auger 68. The puddle members 70 on the upstream side in the direction of toner transport have longer lengths of projection from the shaft portion 68A than the puddle members 70 on the downstream side in the direction of toner transport. Specifically, puddle members 70A each having a length of projection H1 are provided on a first axial side of the auger 68, and puddle members 70B each having a length of projection H2 shorter than the length of projection H1 are provided on a second axial side of the auger 68. The term "length of projection" used herein refers to the distance from the surface of the shaft portion 68A to the tip of the puddle members 70 in the direction of projection. In the first exemplary embodiment, the first axial side of the auger 68 corresponds to the upstream side in the direction of toner transport, and the second axial side of the auger 68 corresponds to the downstream side in the direction of toner transport. In such a configuration, the amount of toner particles scooped from the storing portion 66 and moved toward the rotating brush 62 by the puddle members 70 with the rotation of the auger 68 is greater on the first axial side of the auger 68 than on the second axial side of the auger 68. That is, the amount of toner particles moved by the puddle members 70 is greater on the upstream side than on the downstream side in the direction of toner transport.

Now, functions of the first exemplary embodiment will be described.

In the cleaning device 60 according to the first exemplary embodiment, the toner band 112 is formed at the first axial end of the photoconductor drum 21. Therefore, toner particles are supplied to the tip of the blade 64 in an area in which the toner band 112 is to be formed (the area is hereinafter referred to as "the band area"). Meanwhile, in an area where no toner band 112 is to be formed (the area is hereinafter referred to as "the no-band area"), the toner particles in the storing portion 66 are moved toward the rotating brush 62 by the puddle members 70, and the toner particles resupplied to the surface 21A of the photoconductor drum 21 from the rotating brush 62 are supplied to the tip of the blade 64.

The toner particles scraped off the surface 21A of the photoconductor drum 21 are collected on a discharge-port side of the storing portion 66, i.e., on the downstream side in the direction of toner transport, by the auger 68. Hence, the amount of toner particles accumulated in the storing portion 66 is greater on the downstream side than on the upstream side in the direction of toner transport. On the downstream side, some toner particles having overflowed from the storing portion 66 may be moved to the rotating brush 62. Therefore, in the cleaning device 60, the amount of toner particles that are moved from the storing portion 66 toward the rotating brush 62 is set so as to be greater on the upstream side than on the downstream side in the direction of toner transport.

Furthermore, in the cleaning device 60, the puddle members 70 move the toner particles from the storing portion 66 toward the rotating brush 62 by the use of the rotational force exerted by the auger 68.

While the first exemplary embodiment concerns a case where the puddle members 70 provided on the auger 68 includes two kinds of puddle members 70A and 70B that are of different lengths of projection, the present invention is not limited to such a case. For example, the puddle members 70 may include three or more kinds of puddle members 70 with different lengths of projection that gradually increase from the upstream side toward the downstream side in the direction of toner transport.

Second Exemplary Embodiment

A cleaning device according to a second exemplary embodiment of the present invention will now be described with reference to relevant drawings. Elements that are the same as those described in the first exemplary embodiment are denoted by their corresponding reference numerals used in the first exemplary embodiment, and description of those elements is omitted.

Figure 7:
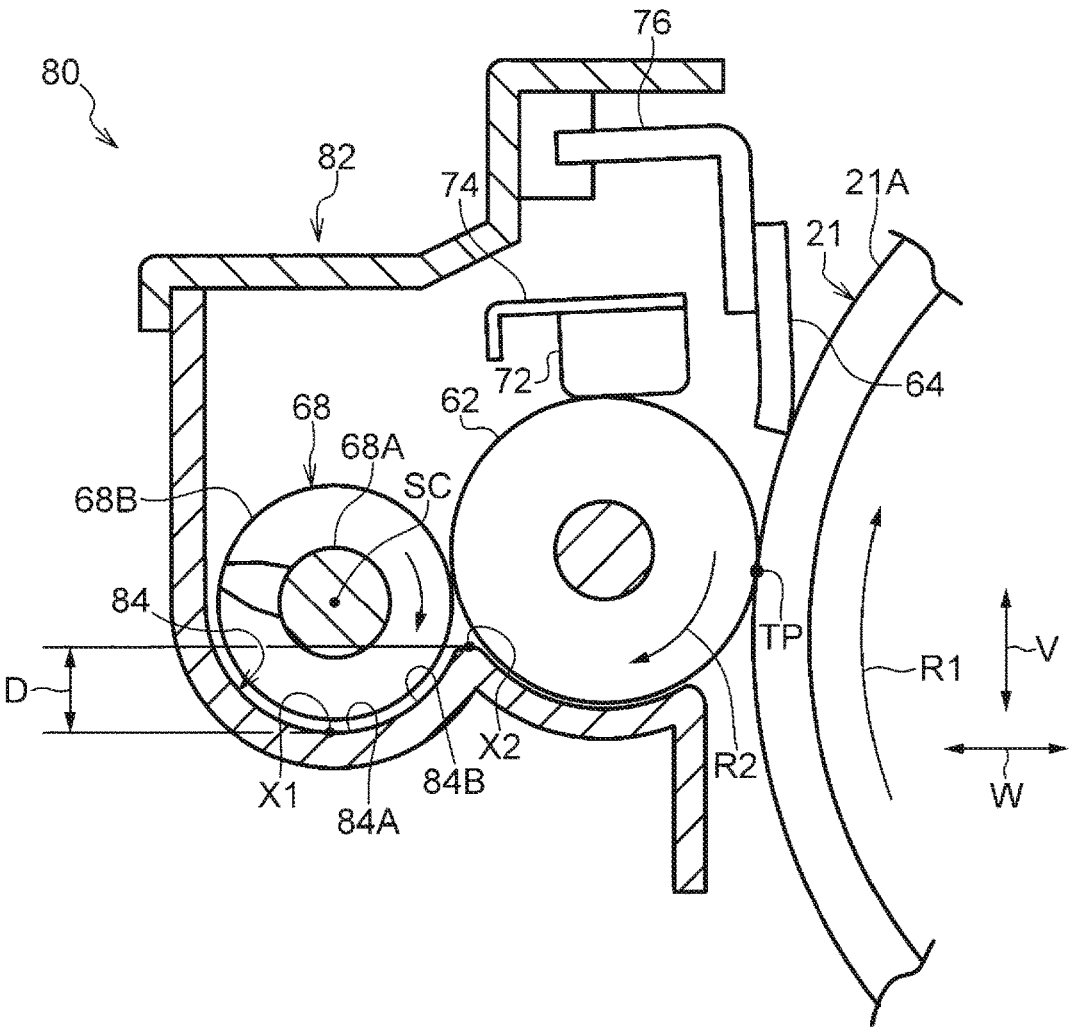
FIG. 7 is a side sectional view of a cleaning device according to a second exemplary embodiment, taken at a position on the upstream side in a direction of toner transport.
Figure 8:
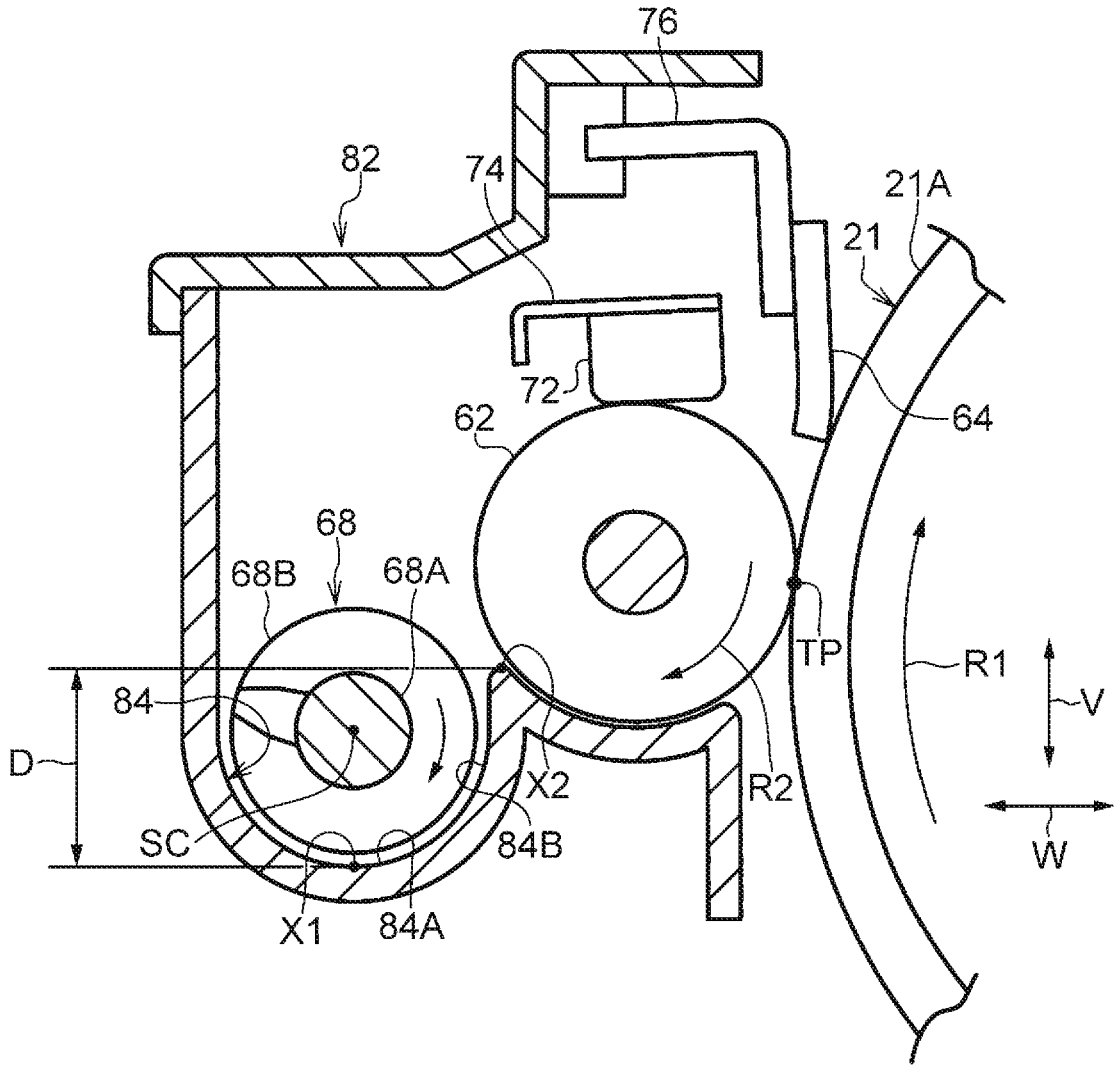
FIG. 8 is a side sectional view of the cleaning device according to the second exemplary embodiment, taken at a position on the downstream side in the direction of toner transport.

Referring to FIGS. 7 and 8, a cleaning device 80 according to the second exemplary embodiment has the same configuration as the cleaning device 60 according to the first exemplary embodiment, except that the cleaning device 80 includes a housing 82 having a storing portion 84, the shaft portion 68A of the auger 68 is tilted, and the auger 68 is provided with no puddle members 70.

The housing 82 has the storing portion 84 at a lower part thereof. The storing portion 84 has a trough-like shape and extends from a first longitudinal end of the housing 82 to a second longitudinal end of the housing 82. A bottom surface 84A of the storing portion 84 is inclined such that a depth D of the storing portion 84 is shallower on the upstream side than on the downstream side in the direction of toner transport. The term "depth" used herein refers to the vertical distance from, in a section taken orthogonally to the direction in which the storing portion 84 extends, a lowest point X1 of the bottom surface 84A to a highest point X2 of a sidewall 84B of the storing portion 84, the sidewall 84B facing the rotating brush 62. While the second exemplary embodiment concerns a case where the bottom surface 84A is a continuous slope inclining from the upstream side to the downstream side in the direction of toner transport, the present invention is not limited to such a case. The bottom surface 84A may be a stepped surface graded from the upstream side to the downstream side in the direction of toner transport. The bottom surface 84A according to the second exemplary embodiment is an exemplary moving member according to the present invention.

The auger 68 is tilted with respect to the vertical direction such that the distance from an axis SC thereof to the bottom surface 84A is constant.

Now, functions of the second exemplary embodiment will be described. Description of functions that are obtained by the same elements of the cleaning device 60 according to the first exemplary embodiment is omitted.

In the cleaning device 80, the bottom surface 84A of the storing portion 84 is inclined such that the depth D of the storing portion 84 is shallower on the upstream side than on the downstream side in the direction of toner transport. Therefore, in the storing portion 84, the point X1 of the bottom surface 84A is nearer to the point X2 of the sidewall 84B on the upstream side of the storing portion 84 in the direction of toner transport, unlike the case where the depth D of the storing portion 84 is constant in the direction of toner transport.

Furthermore, in the cleaning device 80, the storing portion 84 has an improved shape so that the toner particles stored therein are moved toward the rotating brush 62.

Third Exemplary Embodiment

A cleaning device according to a third exemplary embodiment of the present invention will now be described with reference to relevant drawings. Elements that are the same as those described in the first exemplary embodiment are denoted by their corresponding reference numerals used in the first exemplary embodiment, and description of those elements is omitted.

Figure 9:
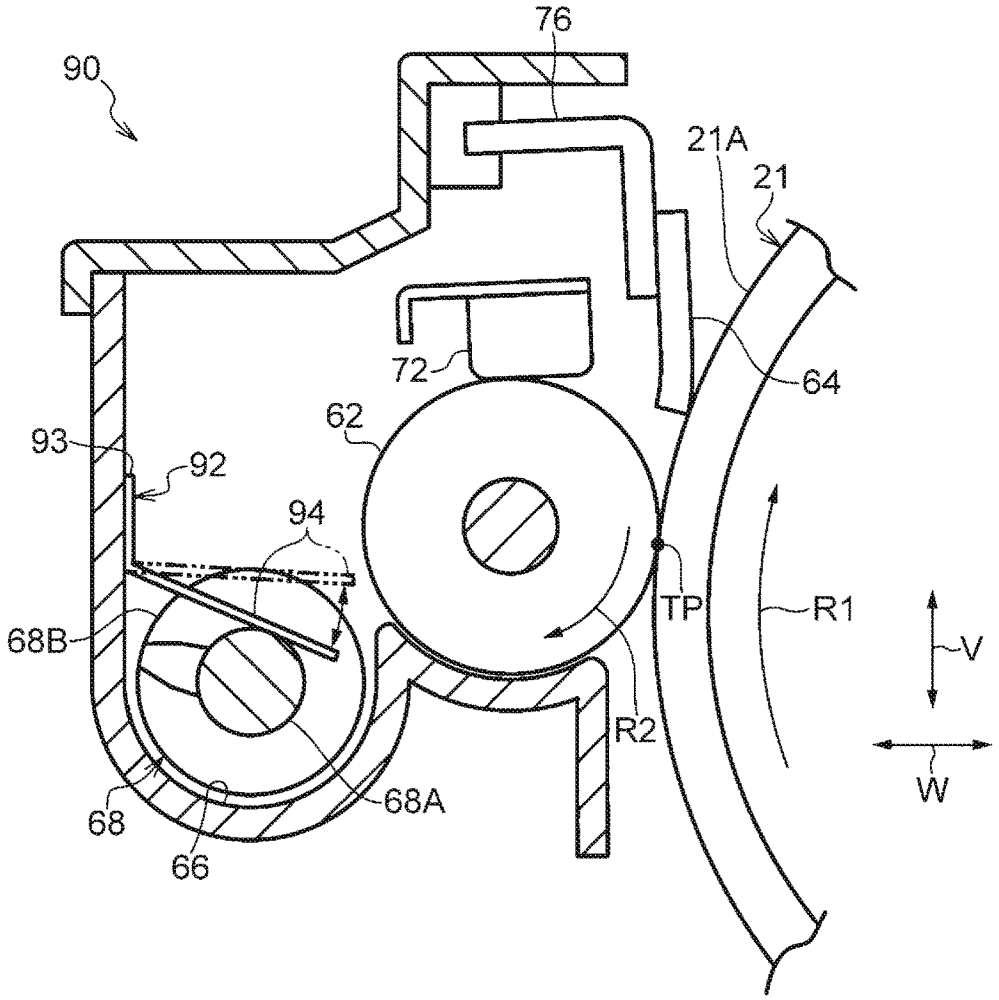
FIG. 9 is a side sectional view of a cleaning device according to a third exemplary embodiment.
Figure 10:
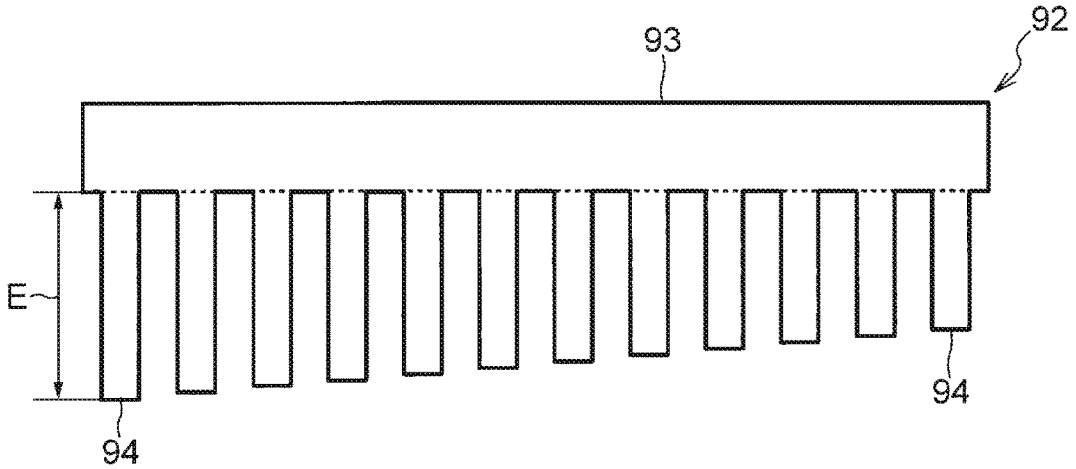
FIG. 10 is a front view of a film member included in the cleaning device according to the third exemplary embodiment.

Referring to FIGS. 9 and 10, a cleaning device 90 according to the third exemplary embodiment has the same configuration as the cleaning device 60 according to the first exemplary embodiment, except that a film member 92 is provided instead of providing the puddle members 70 on the auger 68.

The film member 92 includes a base portion 93 attached to the inner wall of the housing 61 at a position above the storing portion 66. The longitudinal direction of the base portion 93 corresponds to the longitudinal direction of the housing 61. The film member 92 includes plural extended portions 94 extending from the base portion 93. The extended portions 94 are arranged at intervals in the longitudinal direction of the base portion 93. The tips of the extended portions 94 are positioned nearer to the photoconductor drum 21 than the shaft portion 68A of the auger 68. Therefore, the lower surfaces of the extended portions 94 are in contact with the transporting blade 68B of the auger 68. The extended portions 94, which are made of film, are flexible. Hence, when the auger 68 rotates, the extended portions 94 are regularly lifted by the transporting blade 68B. Thus, the extended portions 94 scoop toner particles in the storing portion 66 by the upper surfaces at the tips thereof and move the toner particles toward the rotating brush 62.

The extended portions 94 extending from the base portion 93 have different lengths E that are longer on the upstream side than on the downstream side in the direction of toner transport. Therefore, the amount of toner particles scooped from the storing portion 66 toward the rotating brush 62 by the extended portions 94 when the auger 68 rotates is greater on the upstream side than on the downstream side in the direction of toner transport. That is, the amount of toner particles moved by the film member 92 is greater on the upstream side than on the downstream side in the direction of toner transport.

Fourth Exemplary Embodiment

A cleaning device according to a fourth exemplary embodiment of the present invention will now be described with reference to relevant drawings. Elements that are the same as those described in the first exemplary embodiment are denoted by their corresponding reference numerals used in the first exemplary embodiment, and description of those elements is omitted.

Figure 11:
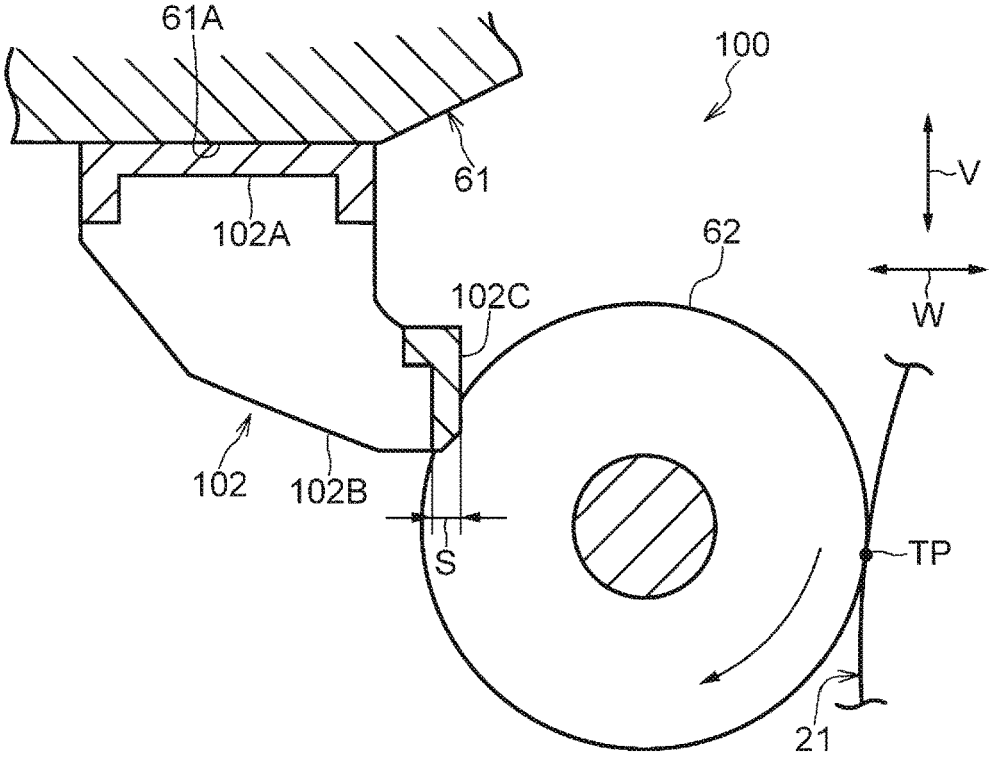
FIG. 11 is a side sectional view of relevant parts of a cleaning device according to a fourth exemplary embodiment, taken at a position on the upstream side in the direction of toner transport.
Figure 12:
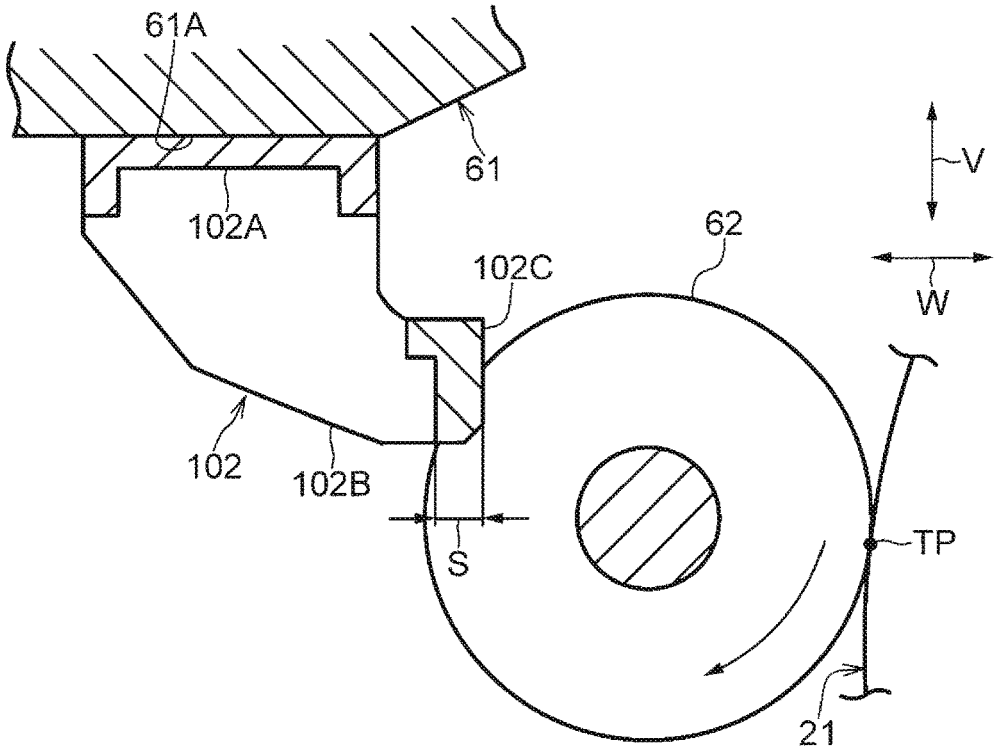
FIG. 12 is a side sectional view of the relevant parts of the cleaning device according to the fourth exemplary embodiment, taken at a position on the downstream side in the direction of toner transport.

Referring to FIGS. 11 and 12, a cleaning device 100 according to the fourth exemplary embodiment has the same configuration as the cleaning device 60 according to the first exemplary embodiment, except the configuration of the puddle members 70 provided to the auger 68 and that a long member 102 as an exemplary adjusting member is provided.

In the fourth exemplary embodiment, the puddle members 70 provided to the auger 68 all have the same length of projection.

The long member 102 is provided at a position between, in the direction of rotation of the rotating brush 62, the contact point TP between the rotating brush 62 and the photoconductor drum 21 and the lubricant supplying member 72. The long member 102 is attached to an upper surface 61A of the housing 61. The longitudinal direction of the long member 102 corresponds to the longitudinal direction of the housing 61 (the axial direction of the rotating brush 62). The long member 102 includes a base body 102A, a pair of arm portions 102B, and a scraping portion 102C. The base body 102A is attached to the upper surface 61A. The scraping portion 102C is supported at two ends thereof by the pair of arm portions 102B. The pair of arm portions 102B extend downward from two respective longitudinal ends of the base body 102A. The scraping portion 102C is in contact with the rotating brush 62 and thus scrapes toner particles off the rotating brush 62. Specifically, when the rotating brush 62 rotates, the bristles of the rotating brush 62 come into contact with the scraping portion 102C of the long member 102. Thus, toner particles caught by the bristles of the rotating brush 62 are scraped off the rotating brush 62.

The long member 102 scrapes toner particles moved from the storing portion 66 to the rotating brush 62 by the puddle members 70 of the auger 68 off the rotating brush 62. Thus, the amount of toner particles to be returned from the rotating brush 62 to the photoconductor drum 21 is adjusted in the axial direction of the photoconductor drum 21. The amount of toner particles scraped off the rotating brush 62 by the long member 102 (the amount is hereinafter referred to as "the amount of scraped toner particles") is greater on the upstream side than on the downstream side in the direction of toner transport. Specifically, a length of projection S of the scraping portion 102C toward the rotating brush 62 is longer on the downstream side than on the upstream side in the direction of toner transport such that the amount of bite of the scraping portion 102C into the rotating brush 62 is greater on the upstream side than on the downstream side in the direction of toner transport. The term "the length of projection" used herein refers to the distance from the back surface to the front surface of the scraping portion 102C. In such a configuration, the amount of bite of the scraping portion 102C into the rotating brush 62 is greater on the downstream side than on the upstream side in the direction of toner transport, and so is the amount of scraped toner particles.

Now, functions of the fourth exemplary embodiment will be described. Description of functions that are obtained by the same elements of the cleaning device 60 according to the first exemplary embodiment is omitted.

In the cleaning device 100, the puddle members 70 provided to the auger 68 all have the same length of projection. Therefore, the amount of toner particles moved from the storing portion 66 toward the rotating brush 62 is greater on the downstream side than on the upstream side in the direction of toner transport. However, since toner particles are scraped off the rotating brush 62 by the scraping portion 102C of the long member 102, the amount of toner particles returned to the photoconductor drum 21 is adjusted in the axial direction of the photoconductor drum 21. Specifically, the amount of toner particles scraped off the rotating brush 62 by the scraping portion 102C of the long member 102 is greater on the downstream side than on the upstream side in the direction of toner transport.

Figure 13:
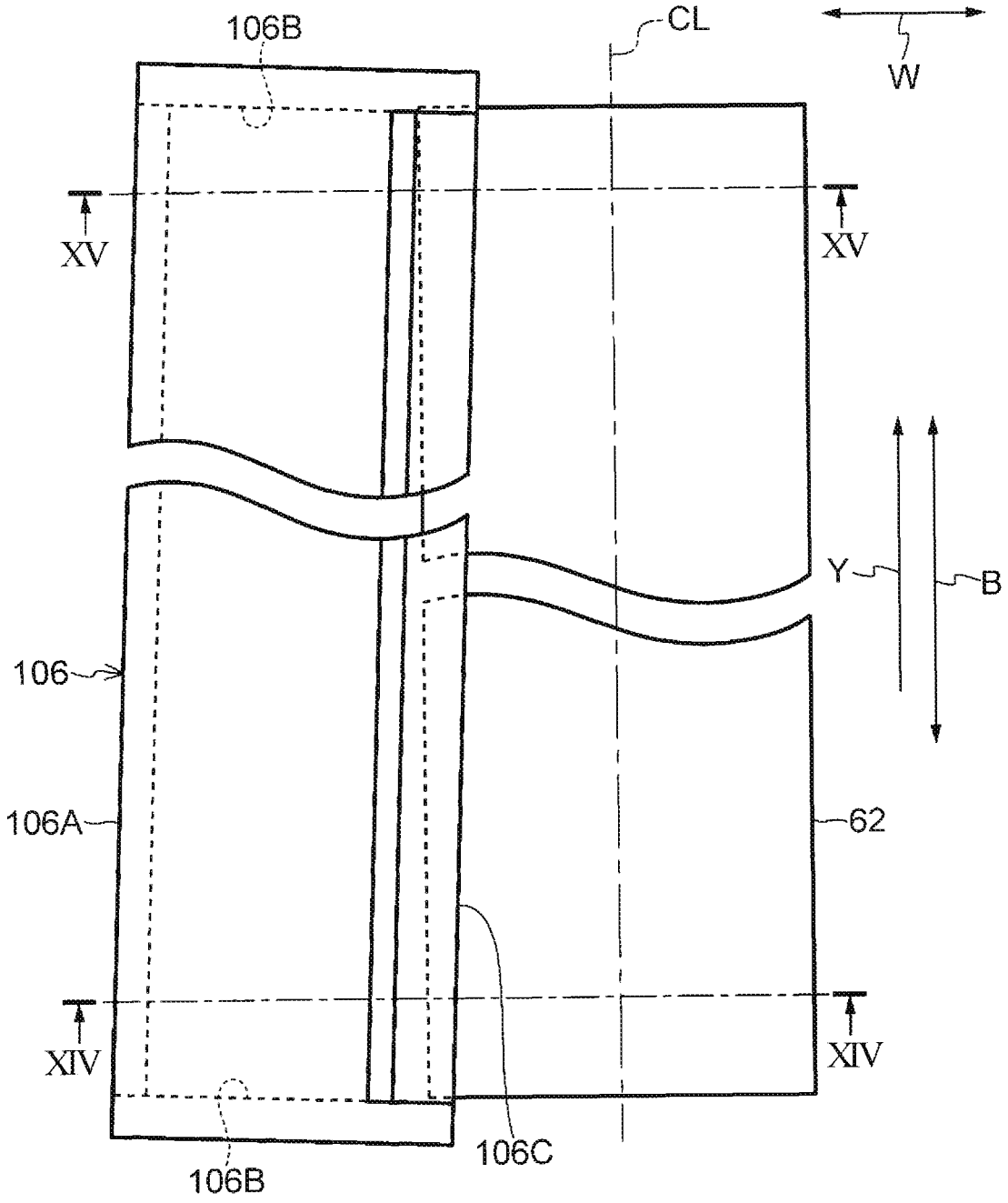
FIG. 13 is a top view of relevant parts of a cleaning device according to a modification of the fourth exemplary embodiment.
Figure 14:
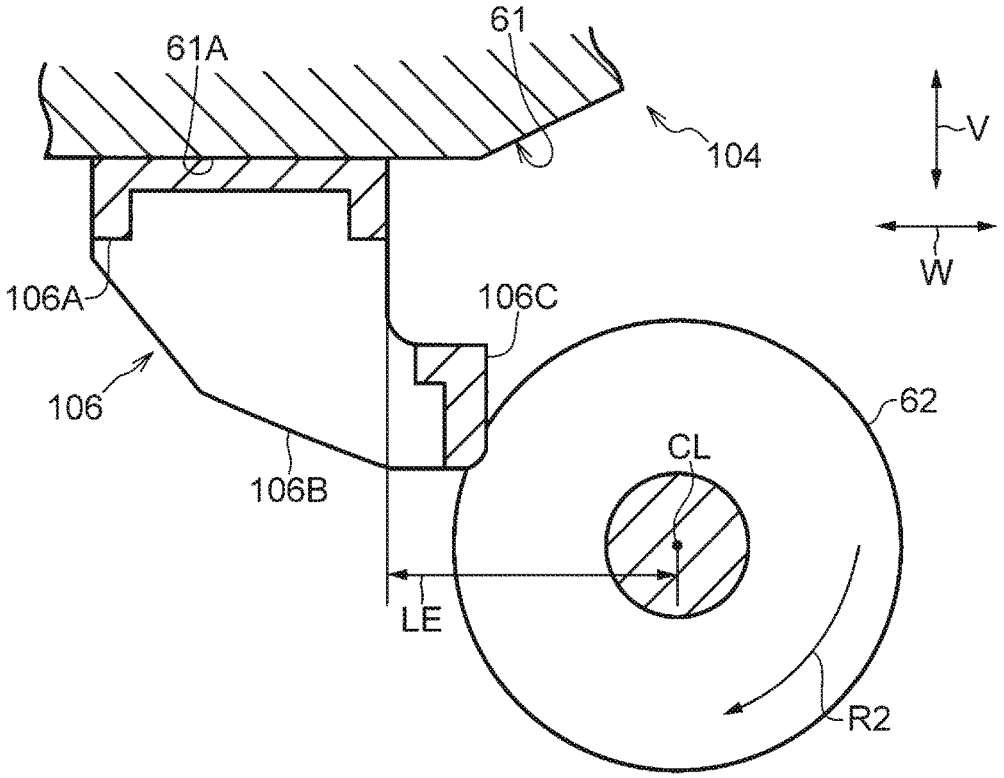
FIG. 14 is a sectional view taken along line XIV-XIV illustrated in FIG. 13.
Figure 15:
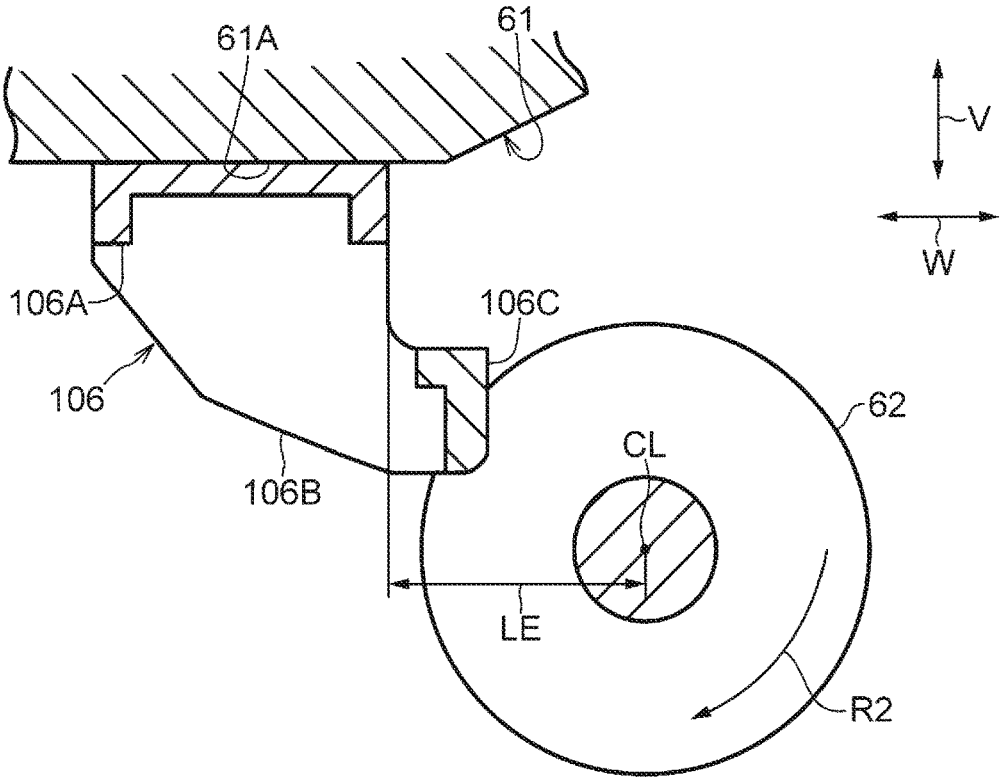
FIG. 15 is a sectional view taken along line XV-XV illustrated in FIG. 13.

While the cleaning device 100 according to the fourth exemplary embodiment concerns a case where the length of projection S of the scraping portion 102C of the long member 102 is longer on the downstream side than on the upstream side in the direction of toner transport, the present invention is not limited to such a case. For example, referring to FIGS. 13 to 15, a long member 106 of a cleaning device 104 according to a modification of the fourth exemplary embodiment includes the scraping portion 102C having a length of projection S that is constant in the direction of toner transport. Instead, a base body 106A of the long member 106 is tilted with respect to an axis of rotation CL of the rotating brush 62 such that the amount of bite of the scraping portion 102C into the rotating brush 62 is greater on the downstream side than on the upstream side in the direction of toner transport. Specifically, the base body 106A is attached to the upper surface 61A of the housing 61 such that a distance LE from the axis of rotation CL of the rotating brush 62 in the horizontal direction (the apparatus-width direction W) is shorter on the downstream side than on the upstream side in the direction of toner transport. That is, the base body 106A is tilted with respect to the axis of rotation CL of the rotating brush 62.

While the fourth exemplary embodiment and the modification thereof each concern a case where the toner particles in the storing portion 66 of the cleaning device 100 or 104 are moved toward the rotating brush 62 by using the auger 68 provided with the puddle members 70 having the same length of projection on the upstream side and on the downstream side in the direction of toner transport, the present invention is not limited to such a case. For example, instead of providing the puddle members 70 to the auger 68, a film member 92 including extended portions 94 all having the same length E may be attached to the housing 61, so that the toner particles in the storing portion 66 are moved toward the rotating brush 62.

While the above exemplary embodiments each concern a case where the toner band 112 is transferred to the continuous-form paper P, the present invention is not limited to such a case. For example, the toner band 112 may be retained on the transfer belt 31, without being transferred from the transfer belt 31 to the continuous-form paper P, and be removed by a cleaning device or the like. The cleaning device that cleans the transfer belt 31 in such a case may be any of the cleaning devices 60, 80, 90, 100, and 104.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a rotating brush configured to supply lubricant to a surface of an image carrying member on which an end toner image is formed at a first axial end;

a cleaning member provided on a downstream side of the rotating brush in a direction of rotation of the image carrying member and configured to clean the image carrying member by scraping toner from the surface of the image carrying member;

a storing portion configured to store the toner scraped by the cleaning member;

a transporting member configured to transport the toner in the storing portion from the first axial end of the image carrying member toward a second axial end of the image carrying member; and a moving member configured to move the toner in the storing portion toward the rotating brush, and the moving member is unevenly arranged along a longitudinal axis of the transporting member.

2. The cleaning device according to claim 1, wherein the moving member is further configured to move a greater amount of toner on an upstream side than on a downstream side in a direction of toner transport by the transporting member.

3. The cleaning device according to claim 2, wherein the transporting member is rotatably supported by a device body with an axial direction of the transporting member being the direction of toner transport, wherein the moving member includes a plurality of plate members provided on the transporting member, the plate members being arranged at intervals in the axial direction of the transporting member, and wherein the plate members provided on the upstream side in the direction of toner transport each have a longer length of projection from the transporting member than the plate members provided on the downstream side in the direction of toner transport.

4. The cleaning device according to claim 2, wherein the transporting member is rotatably supported by a device body with an axial direction of the transporting member being the direction of toner transport, wherein the moving member is a bottom surface of the storing portion, and wherein the bottom surface is inclined such that a depth of the storing portion is shallower on the upstream side than on the downstream side in the direction of toner transport.

5. The cleaning device according to claim 2, wherein the transporting member includes a shaft portion rotatably supported by a device body with an axial direction of the shaft portion being the direction of toner transport; and a substantially helical projecting portion projecting from a surface of the shaft portion, wherein the moving member is a film member including a base portion attached to the device body at a position above the storing portion; and a plurality of extended portions extending from the base portion and arranged at intervals in the direction of toner transport such that tips of the extended portions are positioned nearer to the image carrying member than the shaft portion, with lower surfaces of the extended portions being in contact with the transporting member, and wherein the extended portions provided on the upstream side in the direction of toner transport each have a longer length of extension from the base portion than the extended portions provided on the downstream side in the direction of toner transport.

6. The cleaning device according to claim 1, further comprising an adjusting member configured to adjust, in an axial direction of the image carrying member, an amount of toner returned from the rotating brush to the image carrying member, the adjusting member further configured to come into contact with the rotating brush and scrape the toner moved to the rotating brush by the moving member.

7. The cleaning device according to claim 6, wherein the adjusting member is further configured to scrape a greater amount of toner on a downstream side than on an upstream side in the direction of toner transport by the transporting member.

8. The cleaning device according to claim 7, wherein the adjusting member is a long member including a base body attached to a device body; and a scraping portion supported by the base body with a longitudinal direction of the scraping portion being an axial direction of the rotating brush, the scraping portion configured to scrape the toner off the rotating brush by coming into contact with the rotating brush, and wherein a length of projection of the scraping portion toward the rotating brush is longer on the downstream side than on the upstream side in the direction of toner transport such that an amount of bite of the scraping portion into the rotating brush is greater on the downstream side than on the upstream side in the direction of toner transport.

9. The cleaning device according to claim 7, wherein the adjusting member is a long member including a base body attached to a device body; and a scraping portion supported by the base body with a longitudinal direction of the scraping portion being an axial direction of the rotating brush, the scraping portion configured to scrape the toner off the rotating brush by coming into contact with the rotating brush, and wherein the base body is tilted with respect to an axis of rotation of the rotating brush such that an amount of bite of the scraping portion into the rotating brush is greater on the downstream side than on the upstream side in the direction of toner transport.

10. An image forming apparatus comprising:

an image carrying member on which an end toner image and a toner image are configured to be formed on a surface such that the end toner image is formed at a first axial end of the image carrying member and the toner image is formed in an area containing an axially central area of the image carrying member; and the cleaning device according to claim 1 configured to clean the surface of the image carrying member by scraping toner off the surface of the image carrying member.

11. The cleaning device according to claim 1, wherein the moving member comprises a first plate member and a second plate member arranged at different positions along the longitudinal axis, and wherein the first plate member projects from the transporting member at a first length different than a second length at which the second plate member projects from the transporting member.

12. The cleaning device according to claim 1, wherein the moving member comprises a wall of the storing portion, wherein the wall extends along the longitudinal axis, and wherein the wall increases in height along the longitudinal axis.

13. The cleaning device according to claim 1, wherein the moving member comprises a wall of the storing portion, wherein the wall extends along the longitudinal axis, and wherein the wall increases in height along the longitudinal axis.

14. The cleaning device according to claim 1, wherein the moving member comprises a first film member and a second film member arranged at different positions along the longitudinal axis, and wherein the first film member extends further in an axial direction of the transporting member than the second film member.

15. A cleaning device comprising:

a rotating brush configured to supply lubricant to a surface of an image carrying member on which an end toner image is formed at a first axial end;

a cleaning member provided on a downstream side of the rotating brush in a direction of rotation of the image carrying member and configured to clean the image carrying member by scraping toner from the surface of the image carrying member;

a storing portion configured to store the toner scraped by the cleaning member;

a transporting member configured to transport the toner in the storing portion from the first axial end of the image carrying member toward a second axial end of the image carrying member; and a moving member configured to move the toner in the storing portion toward the rotating brush, wherein the moving member is further configured to move a greater amount of toner on an upstream side than on a downstream side in a direction of toner transport by the transporting member, wherein the transporting member is rotatably supported by a device body with an axial direction of the transporting member being the direction of toner transport, wherein the moving member includes a plurality of plate members provided on the transporting member, the plate members being arranged at intervals in the axial direction of the transporting member, and wherein the plate members provided on the upstream side in the direction of toner transport each have a longer length of projection from the transporting member than the plate members provided on the downstream side in the direction of toner transport.

16. A cleaning device comprising:

a rotating brush configured to supply lubricant to a surface of an image carrying member on which an end toner image is formed at a first axial end;

a cleaning member provided on a downstream side of the rotating brush in a direction of rotation of the image carrying member and configured to clean the image carrying member by scraping toner from the surface of the image carrying member;

a storing portion configured to store the toner scraped by the cleaning member;

a transporting member configured to transport the toner in the storing portion from the first axial end of the image carrying member toward a second axial end of the image carrying member; and a moving member configured to move the toner in the storing portion toward the rotating brush, wherein the moving member is further configured to move a greater amount of toner on an upstream side than on a downstream side in a direction of toner transport by the transporting member, wherein the transporting member is rotatably supported by a device body with an axial direction of the transporting member being the direction of toner transport, wherein the moving member is a bottom surface of the storing portion, and wherein the bottom surface is inclined such that a depth of the storing portion is shallower on the upstream side than on the downstream side in the direction of toner transport.

17. A cleaning device comprising:

a rotating brush configured to supply lubricant to a surface of an image carrying member on which an end toner image is formed at a first axial end;

a cleaning member provided on a downstream side of the rotating brush in a direction of rotation of the image carrying member and configured to clean the image carrying member by scraping toner from the surface of the image carrying member;

a storing portion configured to store the toner scraped by the cleaning member;

a transporting member configured to transport the toner in the storing portion from the first axial end of the image carrying member toward a second axial end of the image carrying member; and a moving member configured to move the toner in the storing portion toward the rotating brush, wherein the moving member is further configured to move a greater amount of toner on an upstream side than on a downstream side in a direction of toner transport by the transporting member, wherein the transporting member includes a shaft portion rotatably supported by a device body with an axial direction of the shaft portion being the direction of toner transport; and a substantially helical projecting portion projecting from a surface of the shaft portion, wherein the moving member is a film member including a base portion attached to the device body at a position above the storing portion; and a plurality of extended portions extending from the base portion and arranged at intervals in the direction of toner transport such that tips of the extended portions are positioned nearer to the image carrying member than the shaft portion, with lower surfaces of the extended portions being in contact with the transporting member, and wherein the extended portions provided on the upstream side in the direction of toner transport each have a longer length of extension from the base portion than the extended portions provided on the downstream side in the direction of toner transport.

18. A cleaning device comprising:

a rotating brush configured to supply lubricant to a surface of an image carrying member on which an end toner image is formed at a first axial end;

a cleaning member provided on a downstream side of the rotating brush in a direction of rotation of the image carrying member and configured to clean the image carrying member by scraping toner from the surface of the image carrying member;

a storing portion configured to store the toner scraped by the cleaning member;

a transporting member configured to transport the toner in the storing portion from the first axial end of the image carrying member toward a second axial end of the image carrying member;

a moving member configured to move the toner in the storing portion toward the rotating brush;

an adjusting member configured to adjust, in an axial direction of the image carrying member, an amount of toner returned from the rotating brush to the image carrying member, the adjusting member further configured to come into contact with the rotating brush and scrape the toner moved to the rotating brush by the moving member, wherein the adjusting member is further configured to scrape a greater amount of toner on a downstream side than on an upstream side in the direction of toner transport by the transporting member.

19. An image forming apparatus comprising:

an image carrying member on which an end toner image and a toner image are configured to be formed on a surface such that the end toner image is formed at a first axial end of the image carrying member and the toner image is formed in an area containing an axially central area of the image carrying member; and a cleaning device configured to clean the surface of the image carrying member by scraping toner off the surface of the image carrying member, the cleaning device comprising:

a rotating brush configured to supply lubricant to a surface of an image carrying member on which an end toner image is formed at a first axial end;

a cleaning member provided on a downstream side of the rotating brush in a direction of rotation of the image carrying member and configured to clean the image carrying member by scraping toner from the surface of the image carrying member;

a storing portion configured to store the toner scraped by the cleaning member;

a transporting member configured to transport the toner in the storing portion from the first axial end of the image carrying member toward a second axial end of the image carrying member; and a moving member configured to move the toner in the storing portion toward the rotating brush, wherein the moving member is further configured to move a greater amount of toner on an upstream side than on a downstream side in a direction of toner transport by the transporting member.

20. The image forming apparatus according to claim 19, wherein the image carrying member is further configured to form a plurality of end toner images, including the end toner image, wherein the end toner images comprises toner particles that are regularly ejected from a developing device of the image forming apparatus, and wherein the end toner images comprise a same shape.

21. The image forming apparatus according to claim 19, wherein the image carrying member is further configured to form the end toner image and the toner image at different image forming areas on the surface.

22. A cleaning device comprising:

a rotating brush configured to supply lubricant to a surface of an image carrying member on which an end toner image is formed at a first axial end;

a cleaning member provided on a downstream side of the rotating brush in a direction of rotation of the image carrying member and configured to clean the image carrying member by scraping toner from the surface of the image carrying member;

a storing portion configured to store the toner scraped by the cleaning member;

a transporting member configured to transport the toner in the storing portion from the first axial end of the image carrying member toward a second axial end of the image carrying member; and a plurality of moving members configured to move the toner in the storing portion toward the rotating brush, wherein shapes of the moving members are different along a longitudinal axis of the transporting member.

* * * * *